US007214277B2

(12) United States Patent
Kurosaki et al.

(10) Patent No.: US 7,214,277 B2
(45) Date of Patent: May 8, 2007

(54) METHOD FOR MANUFACTURING NON-ORIENTED ELECTRICAL STEEL SHEET HAVING HIGH MAGNETIC FLUX DENSITY

(75) Inventors: Yousuke Kurosaki, Futtsu (JP); Takeshi Kubota, Futtsu (JP); Hideaki Yamamura, Futtsu (JP); Takashi Arai, Futtsu (JP); Eiichiro Ishimaru, Hikari (JP); Yoshihiro Arita, Kitakyushu (JP); Isao Suichi, Hikari (JP); Kenji Kosuge, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 576 days.

(21) Appl. No.: 10/819,939

(22) Filed: Apr. 8, 2004

(65) Prior Publication Data

US 2004/0200548 A1 Oct. 14, 2004

(30) Foreign Application Priority Data

Apr. 10, 2003 (JP) ..... 2003-106992

(51) Int. Cl.
*H01F 1/16* (2006.01)
*H01F 1/147* (2006.01)

(52) U.S. Cl. ..... 148/120; 148/111

(58) Field of Classification Search ..... None
See application file for complete search history.

(56) References Cited

U.S. PATENT DOCUMENTS 5,697,425 A * 12/1997 Nanba et al. ..... 164/468
6,638,368 B2 * 10/2003 Tanaka et al. ..... 148/120
6,743,304 B2 * 6/2004 Kawamata et al. ..... 148/306
2002/0043299 A1 * 4/2002 Tanaka et al. ..... 148/111

FOREIGN PATENT DOCUMENTS

| | | | |
|---|---|---|---|
| JP | 62-240714 | A | 10/1987 |
| JP | 2-192853 | A | 7/1990 |
| JP | 5-277657 | A | 10/1993 |
| JP | 6-128642 | A | 5/1994 |
| KR | 97007160 | B1 | 5/1997 |

* cited by examiner

*Primary Examiner*—John P. Sheehan
(74) *Attorney, Agent, or Firm*—Birch, Stewart, Kolasch & Birch, LLP

(57) ABSTRACT

A quench solidification method, wherein a steel cast strip having a mean grain size 50 μm or more is prepared and then the steel cast strip is rolled to produce a non-oriented electrical steel sheet having high magnetic flux density in both L and C directions. However the magnetic flux density reduces when the cold reduction rate exceeds 70%. To avoid this problem the non-oriented electrical steel sheet is manufactured with a ratio of at least 4 of the integrated intensity of the {100} plane for a given sample of steel to the integrated intensity of {100} plane for a "random" sample in which crystal grains have random orientations; and a cold reduction rate of the cold-rolling is between 70% and 85%. The superheating degree of the molten steel can be 70° C. or more.

18 Claims, 2 Drawing Sheets

{100} POLE INTENSITY : 1.3

{100} POLE INTENSITY : 6.4

METHOD FOR MANUFACTURING NON-ORIENTED ELECTRICAL STEEL SHEET HAVING HIGH MAGNETIC FLUX DENSITY

BACKGROUND OF THE INVENTION

The present application claims priority to Japanese Application 2003-106992, filed in Japan on Apr. 10, 2003 and which is herein incorporated by reference in its entirety.

FIELD OF THE INVENTION

The present invention relates to a method for manufacturing low iron loss non-oriented electrical steel sheet having extremely high magnetic flux density in the L and C directions.

DESCRIPTION OF THE RELATED ART

Non-oriented electrical steel sheets are used for large sized generators, motors, and small sized stationary electric devices such as stabilizers or devices for audio goods.

Cut-outs of steel sheets, such as shown in FIG. 1, have magnetic paths formed mainly in the rolling direction (hereinafter referred to as L direction) and in the perpendicular direction to the L direction (hereinafter referred to as the C direction). Recently a split core shown in FIG. 1 or a stator core formed by arranging cut-out T-shaped steel sheets annularly has been used for manufacturing an electric motor. A low iron loss non-oriented electrical steel sheet having high magnetic flux density in L and C direction has been demanded for these products.

A quench solidification method is one of the manufacturing methods for making the non-oriented electrical steel sheet having high magnetic flux density. In quench solidification, molten steel is solidified on a moving cooling wall to form a steel cast strip, and the steel cast strip is cold-rolled to a predetermined thickness then annealed in a final step to become a non-oriented electrical steel sheet. In Unexamined Japanese Patent Application Publication No. 62-240714 (JP '714), a method is disclosed where a steel cast strip having a mean grain size equal to or more than 50 μm is prepared and then the steel cast strip is rolled so as to establish a reduction rate of more than 50%. In Example 1 (JP '714), it is reasonable to conclude that the starting steel material contains equiaxial crystals, since the starting steel cast strip is disclosed to have crystals having a mean grain size of 0.5 mm and the thickness of the strip is 1.4 mm. It is also disclosed that the texture suitable for the stated purpose is obtained by controlling the cold reduction rate. For example, a {100}<001> type texture suitable for a small stationary electric device is obtained with more than a 50% reduction rate and a {100}<025> type texture suitable for a rotational machine is obtained with more than a 70% cold reduction rate. FIG. 2 in JP '714 shows that there is a relationship between a cold reduction rate and a magnetic flux density in both L and C directions, i.e., the magnetic flux density decreases as the reduction rate exceeds 70%.

Large sized generators, small sized stationary devices and motors having a split core require a steel sheet having high magnetic flux density in both L and C directions to save energy and resources. However, a non-oriented electrical steel sheet having a very high magnetic flux density (especially in both L and C directions) can not be obtained by the method disclosed in JP '714, because: (a) the molten steel is solidified at a cold reduction rate exceeding 70% on a moving cooling wall; and (b) the steel cast strip has crystals having mean grain size of more than 50 μm. As disclosed infra, under conditions (a) and (b), the magnetic flux density increases with increasing cold reduction rate until the reduction rate hits about 70% at which point the magnetic flux begins to decrease.

Generally it is known that cracks are likely to occur by rolling a steel cast strip at room temperature where the steel cast strip is obtained with a quench solidification method because the steel cast strip obtained with quench solidification method is very brittle.

SUMMARY OF THE INVENTION

An object of the invention is to provide a method for manufacturing a low iron loss non-oriented electrical steel sheet having extremely high magnetic flux density in L and C directions which can not be obtained by the method disclosed in JP '714.

The object is accomplished by the following method.

A method for manufacturing non-oriented electrical steel sheet having high magnetic flux density comprising the steps of: preparing a molten steel containing, in mass %, 0.008% or less of C, 1.8% to 7% of (Si+2Al), 0.02 to 1.0% of Mn, 0.005% or less of S, 0.01% or less of N, and the balance Fe and unavoidable impurities; solidifying the molten steel on at least one moving cooling wall to form a steel cast strip; cold-rolling the steel cast strip to a predetermined thickness; and finally annealing the cold-rolled steel; wherein the {100} pole intensity, which is a ratio of the integrated inverse pole intensity of the {100} plane at the midplane of a steel cast strip [for a given sample of the cold-rolled steel] to the integrated inverse pole intensity of {100} plane for a "random" sample in which crystal grains have random orientations, is at least 4 and a cold reduction rate of the cold-rolling is between 70% and 85%.

In an embodiment of the invention, the superheating degree of the molten steel before the solidification is 70° C. or more. A superheating degree of molten steel is defined as a difference between the molten steel temperature at the casting and liquidus temperature.

DETAILED DESCRIPTION OF THE INVENTION

Figure 1:
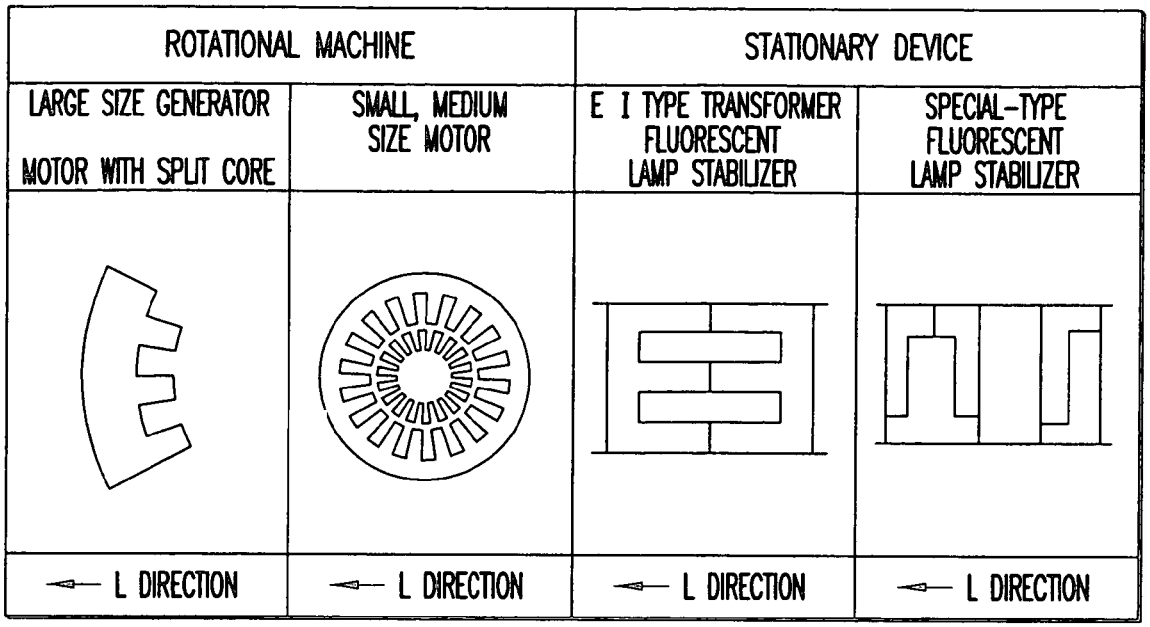
FIG. 1 shows applications of non-oriented electrical steel sheet and a blank layout for the application.
Figure 2:
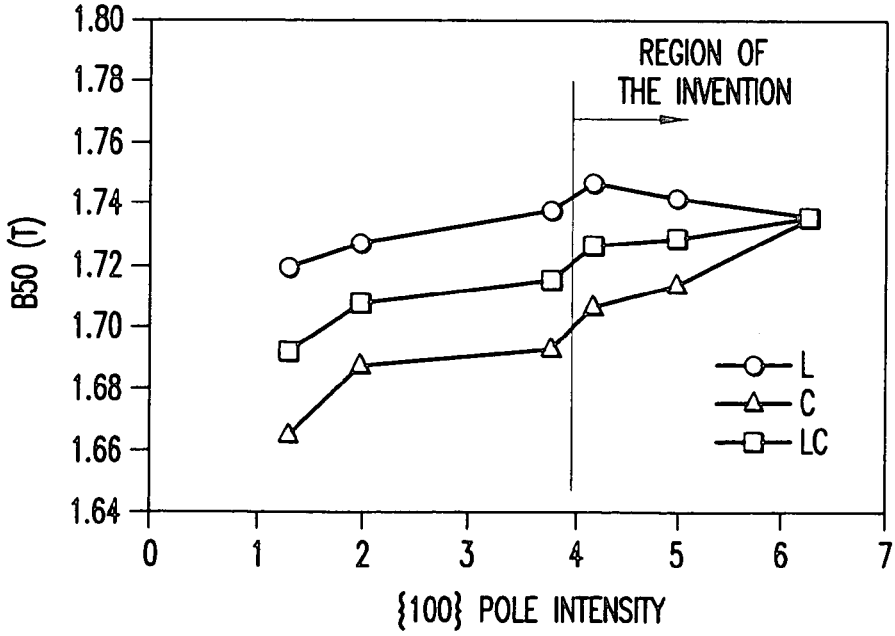
FIG. 2 is a graph showing a relationship between a {100} pole intensity and a magnetic flux density $B_{50}$.

It was found that it is very effective to control the solidified structure, the texture of a steel cast strip and the cold reduction rate (applied to the strip within a certain narrow range) in the quench solidification method in order to manufacture the non-oriented electrical steel sheet having high magnetic flux density. FIG. 2 shows an example of experimental results performed by the inventors. Molten steel containing, in mass %, 0.0011 to 0.0013% of C, 3.1% of Si, 1.1% of Al, 0.26% of Mn, 0.0022 to 0.0026% of S and 0.0013 to 0.0016% of N, was quench solidified by a twin roll method under various conditions to form a steel cast strip with 1.6 mm thickness. The steel cast strip was cold-rolled at room temperature with a 78% reduction rate to form a 0.35 mm thick steel sheet and the steel sheet was finally annealed at 1075° C. for 30 seconds. FIG. 2 shows that there is a relationship between: a) a ratio of the integrated inverse pole intensity of {100} at the midplane of a steel cast strip to the integrated inverse pole intensity of {100} plane for a "random" sample in which crystal grains have random orientations (herein referred to as simply "{100} pole intensity"); and b) a magnetic flux density $B_{50}$ of the steel sheet in L, C and LC directions. FIG. 2 indicates that magnetic flux density increases as {100} pole intensity exceeds 4. In the samples of FIG. 2, different {100} pole intensities were prepared by changing the superheating degree of molten steel.

Figure 3A:
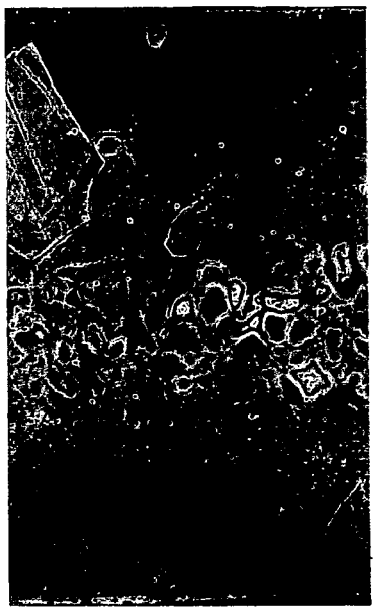
FIG. 3*a*) is a photo showing a solidified structure of a steel cast strip of which the {100} pole intensity is 1.3.
Figure 3B:
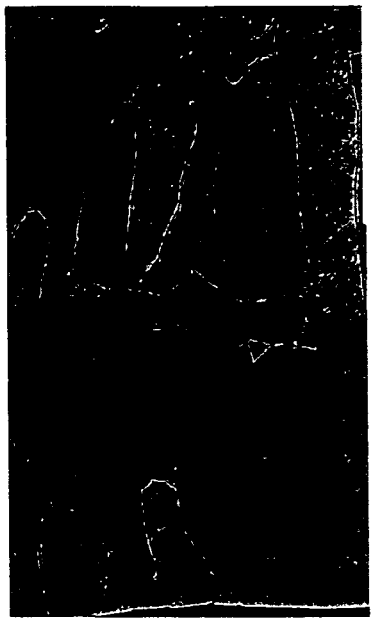
FIG. 3*b*) is a photo showing solidified structure of a steel cast strip of which the {100} pole intensity is 6.4.

FIG. 3 is two photos of strips of the solidified structures. The structure shown in FIG. 3B has a {100} pole intensity of 6.4 and the structure shown in FIG. 3A has a {100} pole intensity of 1.3. In the photos, the vertical direction is the thickness direction of the steel cast strip and the horizontal direction is the casting direction. In FIG. 3B, the sample having a {100} pole intensity of 6.4 has well-developed columnar crystals extending from the surface toward the center layer. On the contrary, in FIG. 3A, the sample having a {100} pole intensity of 1.3 has a lot of spherical equiaxial crystals and almost no columnar crystals. In view of this, it was found that it is important to form a texture which is rich in {100}<0vw> by developing as much columnar crystals as possible.

Figure 4:
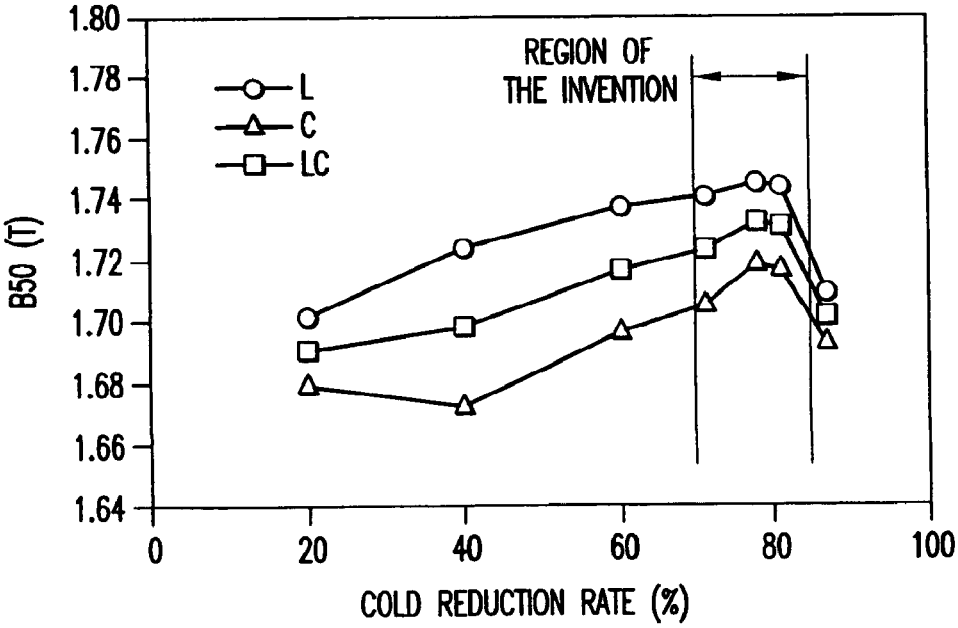
FIG. 4 is a graph showing a relationship between a cold reduction rate and a magnetic flux density $B_{50}$.

FIG. 4 shows the relationship between the cold reduction rate and the magnetic flux density $B_{50}$ with respect to samples of strips obtained by cold-rolling a steel cast strip at room temperature, having a {100} pole intensity of 5.0 which was obtained in the experiment of FIG. 2, with various cold reduction rates, and annealing the strip in a final step at 1075° C. for 30 seconds. FIG. 4 indicates that the highest magnetic flux density is obtained by cold-rolling a steel cast strip of 5.0 {100} pole intensity at 70–85% cold reduction rate.

It was found by the inventors that under the temperature condition of cold-rolling adopted for the samples in FIG. 3 and FIG. 4, edge cracks form in some samples. Table 1, below, shows the relationship between temperature of cold-rolling, depth of edge cracks in a case where cracks are found, and magnetic flux density B50 with respect to samples of strips obtained by cold-rolling a steel cast strip with reduction rate of 78%, having a {100} pole intensity of 5.0 which was obtained in the experiment of FIG. 2, at various rolling temperatures, and annealing the strip in a final step at 1075° C. for 30 seconds.

As shown in Table 1, it is newly found that edge cracks are prevented and an increase of 0.01 T for the magnetic flux density B50 is achieved by cold-rolling of a steel cast strip at a temperature above 180° C.

TABLE 1

| No. | Temperature of Cold-Rolling (° C.) | Depth of edge cracks in a case which cracks are found (mm) | B50 LC (T) |
|---|---|---|---|
| 1 | 20 | 50 | 1.732 |
| 2 | 50 | 45 | 1.732 |

TABLE 1-continued

| No. | Temperature of Cold-Rolling (° C.) | Depth of edge cracks in a case which cracks are found (mm) | B50 LC (T) |
|---|---|---|---|
| 3 | 100 | 20 | 1.737 |
| 4 | 150 | 10 | 1.739 |
| 5 | 180 | No cracks | 1.743 |
| 6 | 250 | No cracks | 1.745 |
| 7 | 350 | No cracks | 1.746 |
| 8 | 370 | No cracks | 1.746 |

In an embodiment of the present invention, the annealing step is performed in a range of 750–1250° C. for 10–180 seconds. Preferably, the annealing step is performed in a range of 850–1200° C. for 20–180 seconds. Most preferably, the annealing step is performed in a range of 1000–1200° C. for 25–60 seconds.

As mentioned above, in the Unexamined Japanese Patent Application Publication No. 62-240714, a method is proposed where a steel cast strip having a mean grain size equal to or more than 50 μm pared and then the steel cast strip is rolled so as to establish a cold reduction rate of more than 50%. In this reference, however, it is reasonable to conclude that equiaxial crystals are used in the starting material. This conclusion is based on the observation that the data given in FIG. 2 of Example 1 of JP '714 is of a strip having a mean grain size of crystals of 0.5 mm and a thickness of 1.4 mm. This steel sample has a reduction in the magnetic flux density as the cold reduction rate exceeds 70%.

In the present invention, it is newly found that the high magnetic flux density can be obtained by using a steel cast strip having columnar crystals and applying a cold reduction rate of 70–85%. While the sample having a {100} pole intensity of 1.3 is recognized to have equiaxial grains in the center layer of the strip as shown in FIG. 3A, the $B_{50}$ in LC direction is 1.69 T at a cold reduction rate of 78%. As shown in FIG. 2, in the region of the present invention where the texture of a steel strip is rich in {100}<0vw> having developed columnar crystals using a 70–85% cold reduction rate, the $B_{50}$ in the LC direction is more than 1.72 T, which leads to increasing the magnetic flux density by 0.03 T or more.

It is also newly found that edge cracks are prevented and an increase of 0.01 T for the magnetic flux density is achieved by cold-rolling of a steel cast strip at a temperature above 180° C., as shown in Table 1, above.

In the steel sheet of the invention, in mass %, the C content is up to 0.008% so that a dual-phase of austenite and ferrite is not formed and a single phase is formed of ferrite which develops as much columnar crystals as possible. Preferably, the C content is 0.0002% to 0.008%.

If the (Si+2Al)% is 1.8% or more and the C % is 0.008% or less, a dual-phase of austenite and ferrite is not formed but a single phase of ferrite is formed, which encourages the columnar crystals to develop. When (Si+2Al) % exceeds 7%, cold-rollability deteriorates. So the upper limit of (Si+2Al) % is 7% and the lower limit is 1.8%.

Mn % is 0.02% to 1% to improve the brittleness. If the Mn content exceeds 1%, the magnetic flux density deteriorates.

S % is 0.005% or less to avoid formation of fine sulfides which have an adverse affect on iron loss. Preferably, the S content is 0.0002% to 0.005%.

N % is 0.01% or less to avoid formation of fine nitrides such as AlN which have an adverse affect on iron loss. Preferably, the N content is 0.0002% to 0.01%.

Molten steel is solidified on at least one moving cooling wall to form a steel cast strip. The single roll method and twin roll method can be used.

The {100} pole intensity should be 4 or more. High magnetic flux density is obtained when columnar crystals are developed in the steel cast strip and the {100} pole intensity is 4 or more as shown in FIG. 2 and FIG. 3.

It is effective to adjust a superheating degree of molten steel in order to control the {100} pole intensity. A superheating degree of molten steel is defined as a difference between the molten steel temperature at the casting and the liquidus temperature. As shown in the example below, a superheating degree of 70° C. or more enable a {100} pole intensity of 4 or more.

The reduction rate of cold-rolling is applied at 70–85 %. As shown in FIG. 4, in the cases when the reduction rate is less than 70% or more than 85%, a high magnetic flux density can not be obtained.

Preferably, cold-rolling before annealing is performed at a temperature between 180 and 350° C. As shown in Table 1 above, in the cases when the cold-rolling is performed below 180° C., there is a possibility that edge cracks will form. In the cases when the cold-rolling is performed above 350° C., the increase in the magnetic flux density B50 is saturated. A strip can be cold-rolled at a temperature above 180° C. by rolling a quench solidified strip before the temperature of the strip comes down below 180° C. A strip can also be heated above 180° C. with using an external heating device such as an electric furnace and a gas oven.

EXAMPLE 1

Molten steel containing, in mass %, 0.0009% of C, 3.0% of Si, 0.20% of Mn, 1.2% of Sol. Al, 0.0007 to 0.0018% of S and 0.0018 to 0.0024% of N, was quench solidified by the twin roll method under various superheating degrees to form steel cast strips with various thicknesses. The liquidus temperature of the steel was 1490° C. Then the steel cast strips were pickled, cold-rolled to steel sheets of 0.35 mm thickness at room temperature, annealed at 1075° C. for 30 seconds and finally coated with an insulation coating. Table 2 below, shows the relationship between a cold reduction rate, magnetic properties and the {100} pole intensity. It was found that the combination of {100} pole intensity of 4 or more and cold reduction rate of 70 to 85% can provide high magnetic flux density.

TABLE 2

| No. | {100} pole intensity | Super-heating degree (° C.) | Steel cast strip thick-ness (mm) | Cold reduction rate (%) | $W_{15/50}$ LC (W/kg) | $B_{50}$ L (T) | $B_{50}$ C (T) | $B_{50}$ LC (T) | |
|---|---|---|---|---|---|---|---|---|---|
| 1 | 2.3 | 30 | 1.59 | 78 | 2.07 | 1.729 | 1.669 | 1.699 | Comp. Ex. |
| 2 | 3.5 | 55 | 1.59 | 78 | 2.06 | 1.734 | 1.691 | 1.713 | Comp. Ex. |
| 3 | 4.1 | 72 | 1.59 | 78 | 2.03 | 1.746 | 1.705 | 1.726 | Inv. Ex. |
| 4 | 5.5 | 88 | 1.59 | 78 | 2.01 | 1.739 | 1.720 | 1.730 | Inv. Ex. |
| 5 | 6.4 | 100 | 1.59 | 78 | 1.98 | 1.734 | 1.733 | 1.734 | Inv. Ex. |
| 6 | 5.5 | 89 | 0.88 | 60 | 2.05 | 1.735 | 1.697 | 1.716 | Comp. Ex. |
| 7 | 5.6 | 90 | 1.09 | 68 | 2.05 | 1.738 | 1.700 | 1.719 | Comp. Ex. |
| 8 | 5.3 | 88 | 1.25 | 72 | 2.03 | 1.741 | 1.707 | 1.724 | Inv. Ex. |
| 9 | 5.4 | 88 | 1.75 | 80 | 1.99 | 1.744 | 1.718 | 1.731 | Inv. Ex. |
| 10 | 5.2 | 85 | 2.19 | 84 | 2.02 | 1.724 | 1.720 | 1.722 | Inv. Ex. |
| 11 | 5.3 | 87 | 2.50 | 86 | 2.07 | 1.710 | 1.699 | 1.705 | Comp. Ex. |

EXAMPLE 2

Table 3 below, shows the relationship between temperature of cold-rolling, a cold reduction rate, depth of edge cracks, the {100} pole intensity and magnetic properties with respect to samples of strips obtained by cold-rolling a steel cast strip to steel sheets of 0.35 mm thickness, which was obtained for preparing the sample No. 9 of Example 1 in Table 2, at various rolling temperatures, annealing the strip at 1075° C. for 30 seconds and applying an insulating membrane on the strip. According to a method of the present invention, a non-oriented electrical steel having high magnetic flux density without edge cracks can be manufactured by adopting conditions of a cold reduction rate of the cold-rolling between 70° C. and 85%, {100} pole intensity of at least 4 and a cold-rolling temperature between 180 and 350° C.

TABLE 3

| No. | {100} pole intensity | Super-heating degree (° C.) | Steel cast strip thick-ness (mm) | Cold reduction rate (%) | Cold reduction temp. (° C.) | Depth of edge cracks (mm) | $W_{15/50}$ LC (W/kg) | $B_{50}$ L (T) | $B_{50}$ C (T) | $B_{50}$ LC (T) | |
|---|---|---|---|---|---|---|---|---|---|---|---|
| 12 | 5.4 | 88 | 1.75 | 80 | 20 | 55 | 1.99 | 1.744 | 1.718 | 1.731 | Inv. Ex. |
| 13 | 5.4 | 88 | 1.75 | 80 | 150 | 20 | 1.99 | 1.746 | 1.720 | 1.733 | Inv. Ex. |
| 14 | 5.4 | 88 | 1.75 | 80 | 180 | 0 | 1.98 | 1.753 | 1.726 | 1.740 | Inv. Ex. |
| 15 | 5.4 | 88 | 1.75 | 80 | 210 | 0 | 1.96 | 1.754 | 1.729 | 1.742 | Inv. Ex. |
| 16 | 5.4 | 88 | 1.75 | 80 | 350 | 0 | 1.96 | 1.754 | 1.729 | 1.741 | Inv. Ex. |

According to a method of the present invention, a low iron loss non-oriented electrical steel sheet having extremely high magnetic flux density in the L and C directions can be manufactured, which is suitable for use as an iron core for a large size electric generator, a small size stationary electric device, a motor (including split core), etc.

What is claimed is:

1. A method for manufacturing non-oriented electrical steel sheet having high magnetic flux density comprising the steps of:

preparing a molten steel comprising, in mass %, up to 0.008% of C, 1.8% to 7% of (Si+2Al), 0.02 to 1.0% of Mn, up to 0.005% of S, up to 0.01% of N, and the balance Fe and unavoidable impurities;

solidifying the molten steel on at least one moving cooling wall to form a steel cast strip;

cold-rolling the steel cast strip to a predetermined thickness; and annealing the cold-rolled steel;

wherein {100} pole intensity is at least 4; and a cold reduction rate of the cold-rolling is between 70% and 85%.

2. A method for manufacturing non-oriented electrical steel sheet having high magnetic flux density comprising the steps of:

preparing a molten steel comprising, in mass %, up to 0.008% of C, 1.8% to 7% of (Si+2Al), 0.02 to 1.0% of Mn, up to 0.005% of S, up to 0.01% of N, and the balance Fe and unavoidable impurities;

solidifying the molten steel on a at least one moving cooling wall to form a steel cast strip;

cold-rolling the steel cast strip to a predetermined thickness; and annealing the cold-rolled steel;

wherein a cold reduction rate of the cold-rolling is between 70% and 85%; and wherein a superheating degree of the molten steel immediately before being solidified is at least 70° C.

3. The method according to claim 1, wherein a superheating degree of the molten steel immediately before being solidified is 70° C. to 100° C.

4. The method according to claim 1, wherein the molten steel comprises, in mass %, 0.0011–0.0013% of C.

5. The method according to claim 1, wherein the cold rolling is performed at a temperature of at least 180° C.

6. The method according to claim 2, wherein the cold rolling is performed at a temperature of at least 180° C.

7. The method according to claim 5, wherein the cold rolling is performed at a temperature of 180 to 350° C.

8. The method according to claim 6, wherein the cold rolling is performed at a temperature of 180 to 350° C.

9. The method according to claim 1, wherein the {100} pole intensity is 4 to 6.4.

10. The method according to claim 1, wherein the cold-rolled steel has columnar crystals.

11. The method according to claim 1, wherein the cold-rolled steel has a greater number of columnar crystals than spherical equiaxial crystals.

12. The method according to claim 1, wherein the molten steel is solidified using the single roll method.

13. The method according to claim 1, wherein the molten steel is solidified using the twin roll method.

14. The method according to claim 2, wherein the molten steel comprises, in mass %, 0.0011–0.0013% of C.

15. The method according to claim 2, wherein the {100} pole intensity is 4 to 6.4.

16. The method according to claim 2, wherein the cold-rolled steel has columnar crystals.

17. The method according to claim 2, wherein the cold-rolled steel has a greater number of columnar crystals than spherical equiaxial crystals.

18. The method according to claim 2, wherein the {100} pole intensity is at least 4.

* * * * *